US009481536B2

(12) United States Patent
Sager et al.

(10) Patent No.: US 9,481,536 B2
(45) Date of Patent: Nov. 1, 2016

(54) CYLINDRICAL SLEEVE

(71) Applicant: AEP Industries Inc., South Hackensack, NJ (US)

(72) Inventors: Randy P. Sager, Newport Coast, CA (US); David Cron, Ho Ho Kus, NJ (US); David Rudd, Lake George, NY (US)

(73) Assignee: AEP Industries Inc., South Hackensack, NJ (US)

( * ) Notice: Subject to any disclaimer, the term of this patent is extended or adjusted under 35 U.S.C. 154(b) by 147 days.

(21) Appl. No.: 14/175,575

(22) Filed: Feb. 7, 2014

(65) Prior Publication Data

US 2015/0225197 A1 Aug. 13, 2015

(51) Int. Cl.

| | |
|---|---|
| ***B65H 75/18*** | (2006.01) |
| ***B65H 18/28*** | (2006.01) |
| ***B65H 75/10*** | (2006.01) |
| ***B65B 67/08*** | (2006.01) |

(52) U.S. Cl.

CPC ..... *B65H 18/28* (2013.01); *B65B 67/085* (2013.01); *B65H 75/10* (2013.01); *B65H 2701/1752* (2013.01); *B65H 2701/5112* (2013.01)

(58) Field of Classification Search

CPC ..... B65H 75/08; B65H 75/10; B65H 75/18; B65H 75/04; B65H 2701/1944; B65H 2701/50; B65H 2701/51; B65H 27/00; B65D 85/672; B65B 11/00; B65B 67/08

See application file for complete search history.

(56) References Cited

U.S. PATENT DOCUMENTS

| | | | | |
|---|---|---|---|---|
| 2,219,836 A * | 10/1940 | Dunlap | B65H 75/28 | 242/118.32 |
| 3,581,744 A * | 6/1971 | Voss | A61F 13/2085 | 428/34.2 |
| 5,555,978 A * | 9/1996 | Elsner | B65H 19/29 | 206/389 |
| 5,910,353 A * | 6/1999 | Machlica | B32B 27/10 | 428/195.1 |
| 2009/0047525 A1* | 2/2009 | Tilton | B32B 27/20 | 428/441 |
| 2011/0057069 A1* | 3/2011 | Hernandez | B31C 3/00 | 242/610.1 |
| 2013/0248643 A1* | 9/2013 | Newhouse | B65H 19/20 | 242/526 |

FOREIGN PATENT DOCUMENTS

| | | | |
|---|---|---|---|
| WO | WO 93/10006 | * | 5/1993 |
| WO | WO-9310006 A1 | | 5/1993 |
| WO | WO-2011154745 A2 | | 12/2011 |

OTHER PUBLICATIONS

International Search Report and Written Opinion for Application No. PCT/US2015/15022 dated May 20, 2015.

* cited by examiner

*Primary Examiner* — William A Rivera

(74) *Attorney, Agent, or Firm* — Honigman Miller Schwartz and Cohn LLP

(57) ABSTRACT

An assembly is disclosed. The assembly includes a cylindrical sleeve and a length of material that is wound upon itself defining a wound roll. The cylindrical sleeve includes an inner surface and an outer surface. The inner surface of the cylindrical sleeve defines a passage extending through the cylindrical sleeve. The length of material includes an inner surface and an outer surface. A portion of the inner surface of the length of material forms a passage extending through the wound roll. The outer surface of the cylindrical sleeve is secured to the portion of the inner surface of the length of material that forms the passage extending through the wound roll. At least a portion of the inner surface of the cylindrical sleeve is defined by a Sheffield Smoothness that is less than 350. A method is also disclosed.

26 Claims, 8 Drawing Sheets

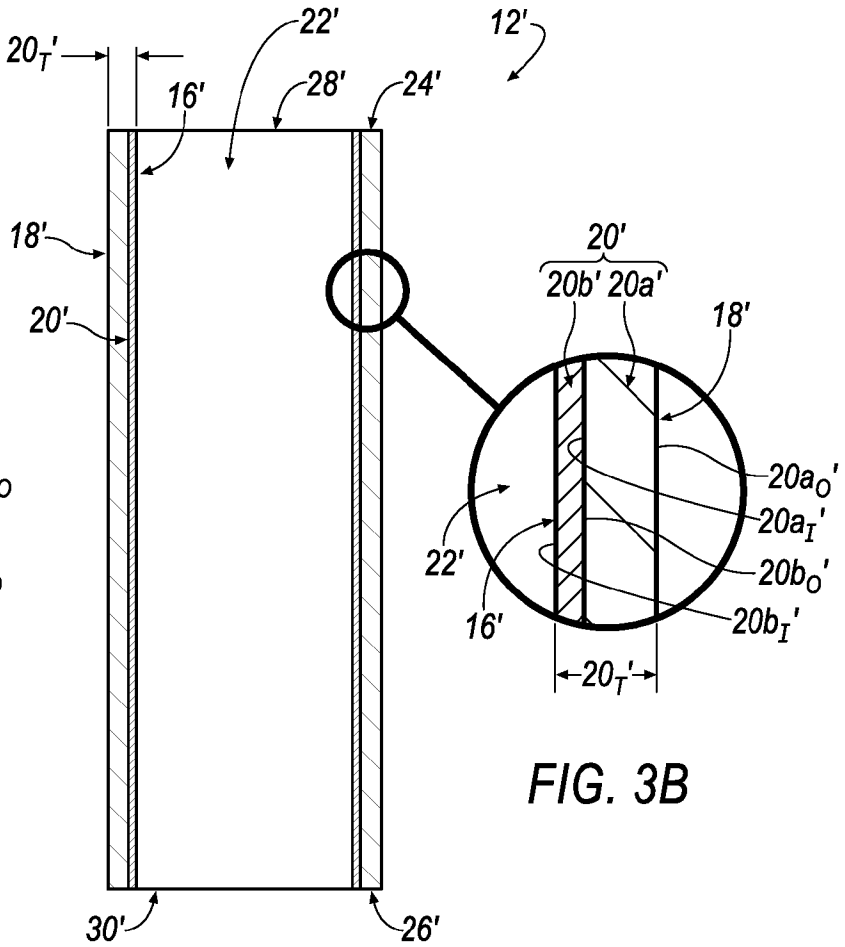
FIG. 2B
FIG. 3B
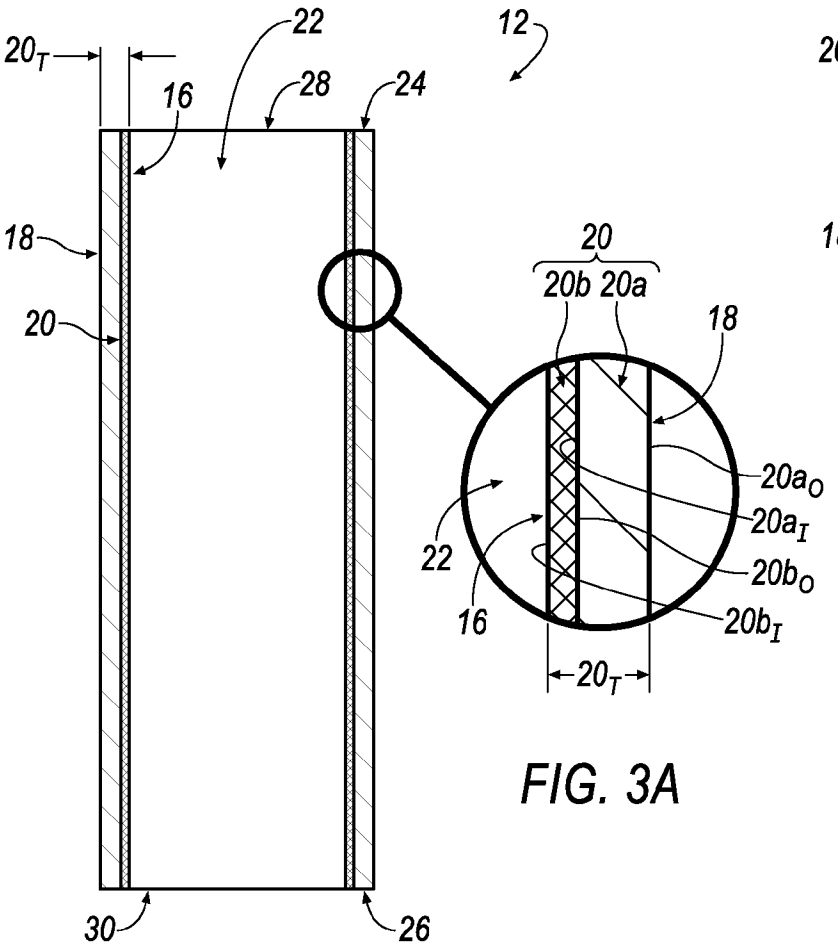
FIG. 2A
FIG. 3A

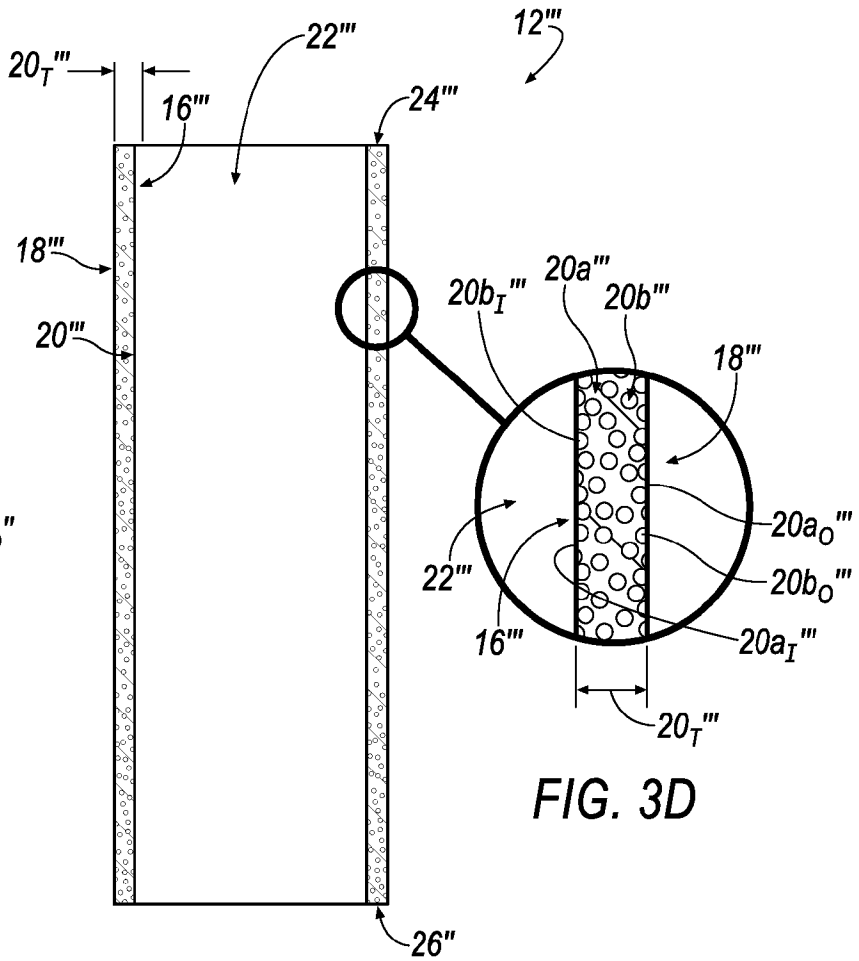
FIG. 3D
FIG. 2D
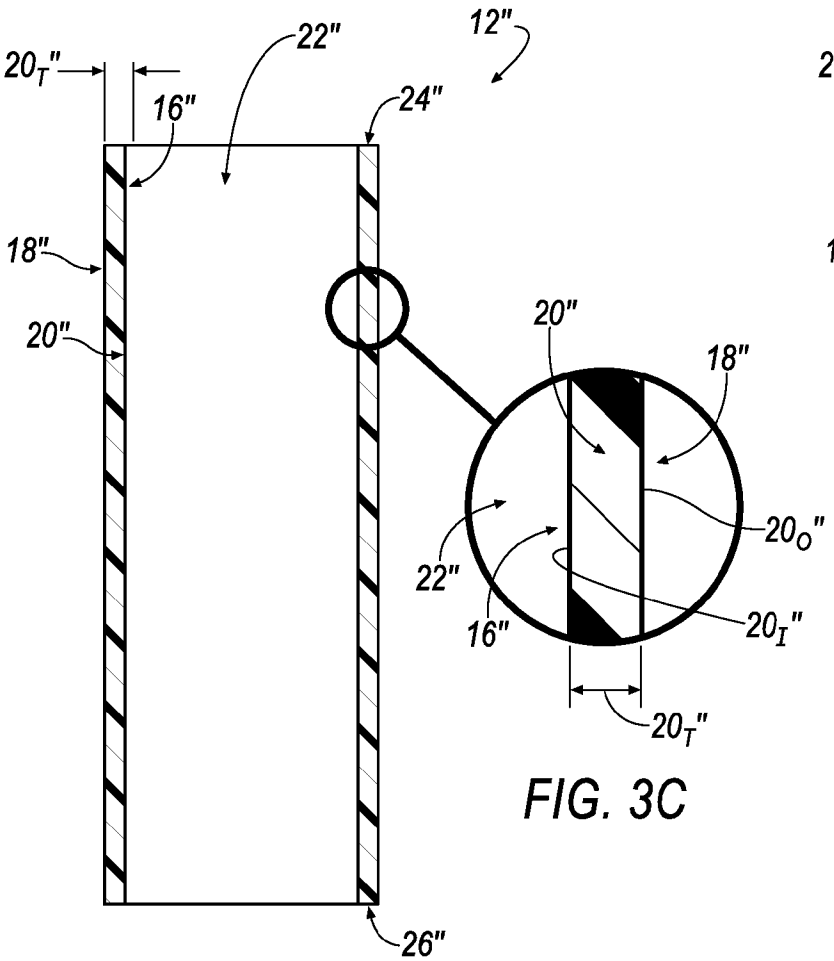
FIG. 3C
FIG. 2C

CYLINDRICAL SLEEVE

FIELD OF THE INVENTION

The disclosure relates to a cylindrical sleeve and a method for utilizing the same.

DESCRIPTION OF THE RELATED ART

Improvements to cylindrical sleeves are continuously being sought in order to advance the arts.

BRIEF DESCRIPTION OF THE DRAWINGS

The disclosure will now be described, by way of example, with reference to the accompanying drawings, in which:

FIG. 2A is a cross-sectional view of the cylindrical sleeve according to line 2-2 of FIG. 1A.

FIG. 2B is a cross-sectional view of the cylindrical sleeve according to line 2-2 of FIG. 1A.

FIG. 2C is a cross-sectional view of the cylindrical sleeve according to line 2-2 of FIG. 1A.

FIG. 2D is a cross-sectional view of the cylindrical sleeve according to line 2-2 of FIG. 1A.

FIG. 3A is an enlarged view of the cylindrical sleeve of FIG. 2A.

FIG. 3B is an enlarged view of the cylindrical sleeve of FIG. 2B.

FIG. 3C is an enlarged view of the cylindrical sleeve of FIG. 2C.

FIG. 3D is an enlarged view of the cylindrical sleeve of FIG. 2D.

SUMMARY

Figure 1A:
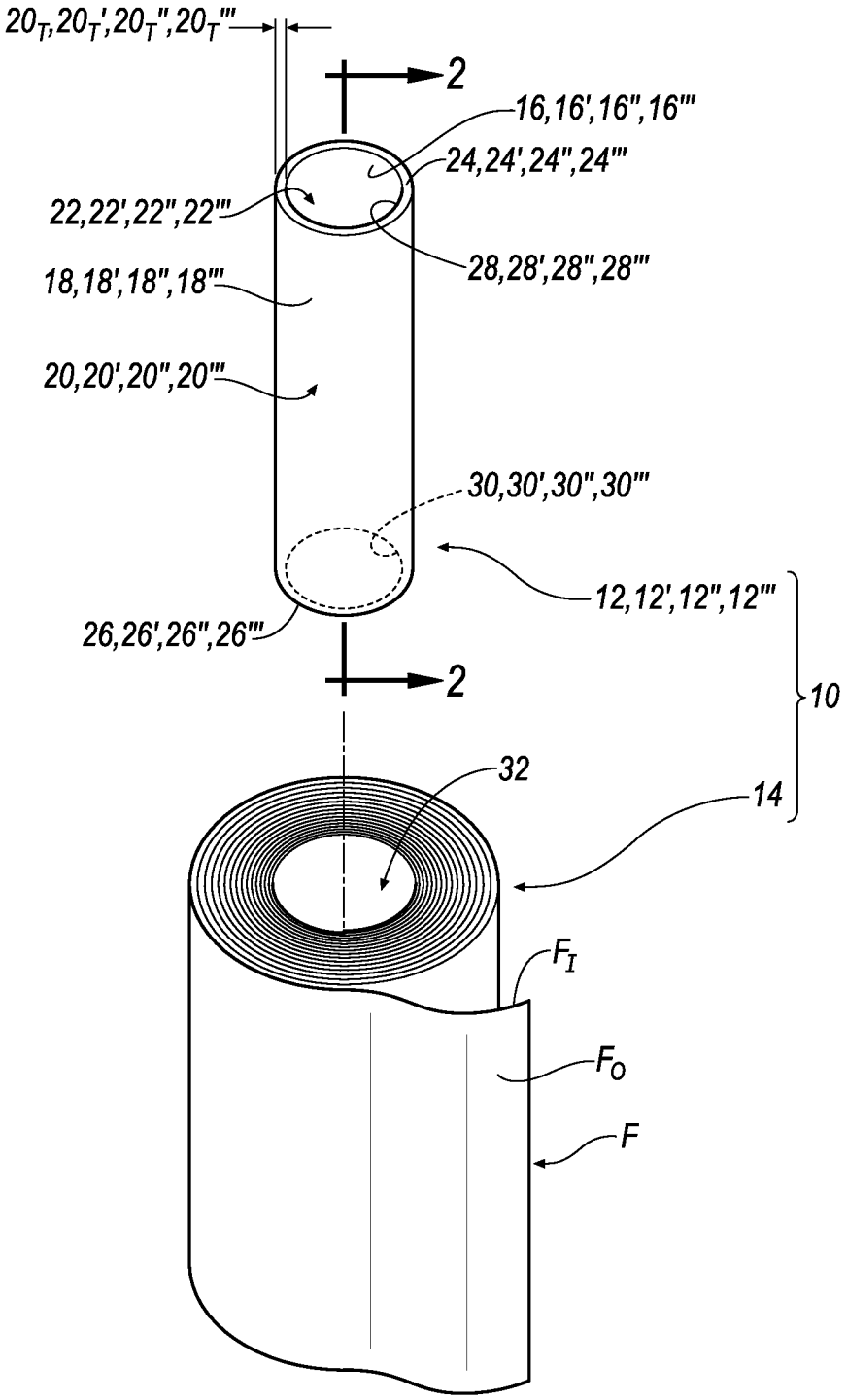
FIG. 1A is an exploded perspective view of an assembly including a cylindrical sleeve in accordance with an exemplary embodiment of the invention.

One aspect of the disclosure provides an assembly. The assembly includes a cylindrical sleeve and a length of material that is wound upon itself defining a wound roll. The cylindrical sleeve includes an inner surface and an outer surface. The inner surface of the cylindrical sleeve defines a passage extending through the cylindrical sleeve. The length of material includes an inner surface and an outer surface. A portion of the inner surface of the length of material forms a passage extending through the wound roll. The outer surface of the cylindrical sleeve is secured to the portion of the inner surface of the length of material that forms the passage extending through the wound roll. At least a portion of the inner surface of the cylindrical sleeve is defined by a Sheffield Smoothness that is less than 350.

In some implementations, the Sheffield Smoothness defined by the inner surface of the cylindrical sleeve is approximately equal to 250.

In some examples, the length of material is a length of wrapping film.

In some instances, the passage extends through the cylindrical sleeve between a distal end of the cylindrical sleeve and a proximal end of the cylindrical sleeve. Access to the passage is permitted by a distal opening formed in the distal end of the cylindrical sleeve and a proximal opening formed in the proximal end of the cylindrical sleeve.

In some implementations, the cylindrical sleeve is defined by a body. The body is defined by a thickness extending between the inner surface and the outer surface.

In some examples, the body is defined by one or more materials.

In some instances, the body includes two materials defined by: a first material and a second material.

In some implementations, the first material forms a first cylindrical body having an inner surface and an outer surface. The outer surface of the first material defines the outer surface of the cylindrical sleeve. The second material forms a second cylindrical body having an inner surface and an outer surface. The inner surface of the second material defines the inner surface of the cylindrical sleeve. The inner surface of the first cylindrical body formed by the first material is disposed adjacent the outer surface of the second cylindrical body formed by the second material.

In some examples, the second material defining the inner surface of the cylindrical sleeve is defined by the Sheffield Smoothness that is less than 350. The first material has a Sheffield Smoothness that is greater than 350.

In some instances, the first material is a rough, cardboard-based paper material.

In some implementations, the second material is a paper liner. The paper liner includes velvet.

In some examples, the second material is a plastic liner.

In some instances, the second material is a plastic coating.

In some implementations, the first material forms a cylindrical body having an inner surface and an outer surface. The inner surface of the cylindrical body defines at least a first portion of the outer surface of the cylindrical sleeve. The outer surface of the cylindrical body defines at least a first portion of the outer surface of the cylindrical sleeve. The second material forms a plurality of impregnations that are disposed throughout the cylindrical body formed by the first material. Some of the plurality of impregnations are entirely contained within the cylindrical body formed by the first material. Some of the plurality of impregnations are not entirely contained within the cylindrical body formed by the first material and thereby defines a plurality of inner surface portions and a plurality of outer surface portions. The plurality of inner surface portions define at least a second portion of the inner surface of the cylindrical sleeve. The plurality of outer surface portions define at least a second portion of the outer surface of the cylindrical sleeve.

In some examples, the second material defining at least the second portion of the inner surface of the cylindrical sleeve is defined by the Sheffield Smoothness that is less than 350. The first material has a Sheffield Smoothness that is greater than 350.

In some instances, the first material is a rough, cardboard-based paper material.

In some implementations, the second material is a hardwood material.

In some examples, the body includes one material that forms a cylindrical body having an inner surface and an outer surface. The outer surface of the cylindrical body defines the outer surface of the cylindrical sleeve. The inner surface of the cylindrical body defines the inner surface of the cylindrical sleeve. The one material that forms the cylindrical body is a non-cardboard-based body.

Another aspect of the disclosure provides a method including a step of providing an assembly. The assembly includes a cylindrical sleeve and a length of material that is wound upon itself defining a wound roll. The cylindrical sleeve includes an inner surface and an outer surface. The inner surface of the cylindrical sleeve defines a passage extending through the cylindrical sleeve. The length of material includes an inner surface and an outer surface. A portion of the inner surface of the length of material forms a passage extending through the wound roll. The outer surface of the cylindrical sleeve is secured to the portion of the inner surface of the length of material that forms the passage extending through the wound roll. At least a portion of the inner surface of the cylindrical sleeve is defined by a Sheffield Smoothness that is less than 350. The method further includes the steps of: without arranging an axial insert disposed within the passage extending through the cylindrical sleeve, arranging an operators hands directly adjacent the portion of the inner surface of the cylindrical sleeve defined by the Sheffield Smoothness that is less than 350; and spinning the wound roll about an axis of rotation extending through the passage extending through the cylindrical sleeve for dispensing the length of material from the wound roll.

In yet another aspect of the disclosure provides an assembly. The assembly includes a cylindrical sleeve and a length of wrapping film that is wound upon itself defining a wound roll. The cylindrical sleeve includes an inner surface and an outer surface. The inner surface of the cylindrical sleeve defines a passage extending through the cylindrical sleeve. The cylindrical sleeve is defined by a body. The body is defined by a first material and a second material. The first material is defined by a Sheffield Smoothness that is greater than 350. The second material is defined by a Sheffield Smoothness that is less than 350. At least a portion of the inner surface of the cylindrical sleeve is defined by the second material having the Sheffield Smoothness that is less than 350. The length of wrapping film includes an inner surface and an outer surface. A portion of the inner surface of the length of wrapping film forms a passage extending through the wound roll. The outer surface of the cylindrical sleeve is secured to the portion of the inner surface of the length of wrapping film that forms the passage extending through the wound roll.

In some examples, the first material is a rough, cardboard-based paper material. The second material is not a rough, cardboard-based paper material.

In some instances, the second material is a paper liner. The paper liner includes velvet.

In some implementations, the second material is a plastic liner.

In some examples, the second material is a plastic coating.

In some instances, the second material is a plurality of hardwood impregnations that are disposed throughout the first material.

DETAILED DESCRIPTION OF THE INVENTION

The Figures illustrate exemplary embodiments of a cylindrical sleeve and a method for utilizing the same. Based on the foregoing, it is to be generally understood that the nomenclature used herein is simply for convenience and the terms used to describe the invention should be given the broadest meaning by one of ordinary skill in the art.

Figure 1B:
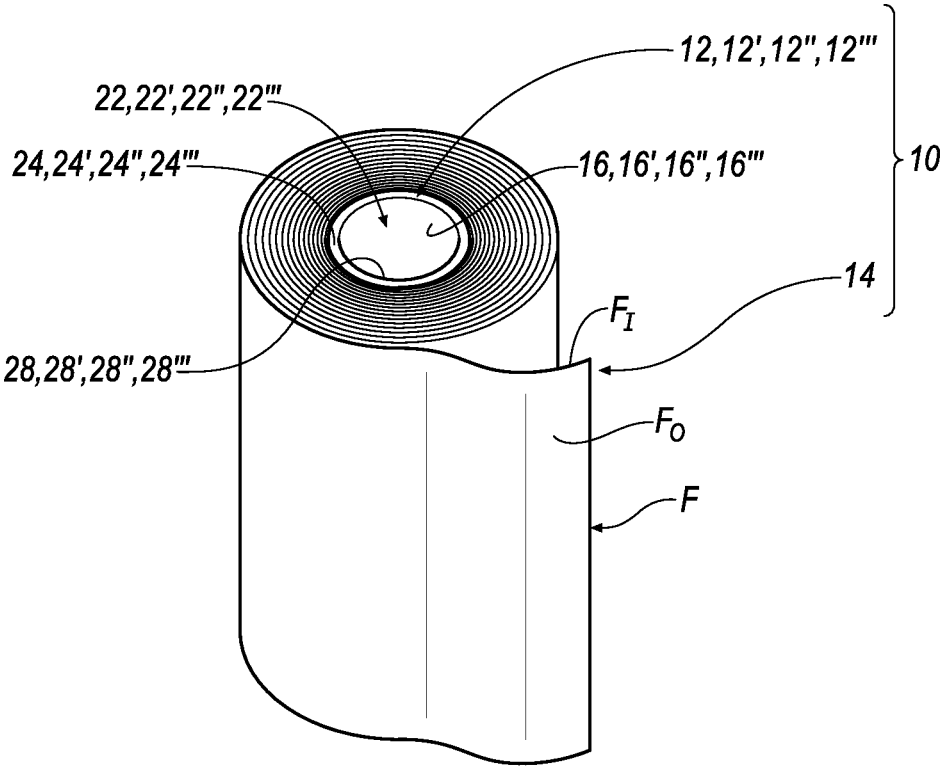
FIG. 1B is an assembled perspective view of the assembly of FIG. 1A.
Figures 2E, 3E:
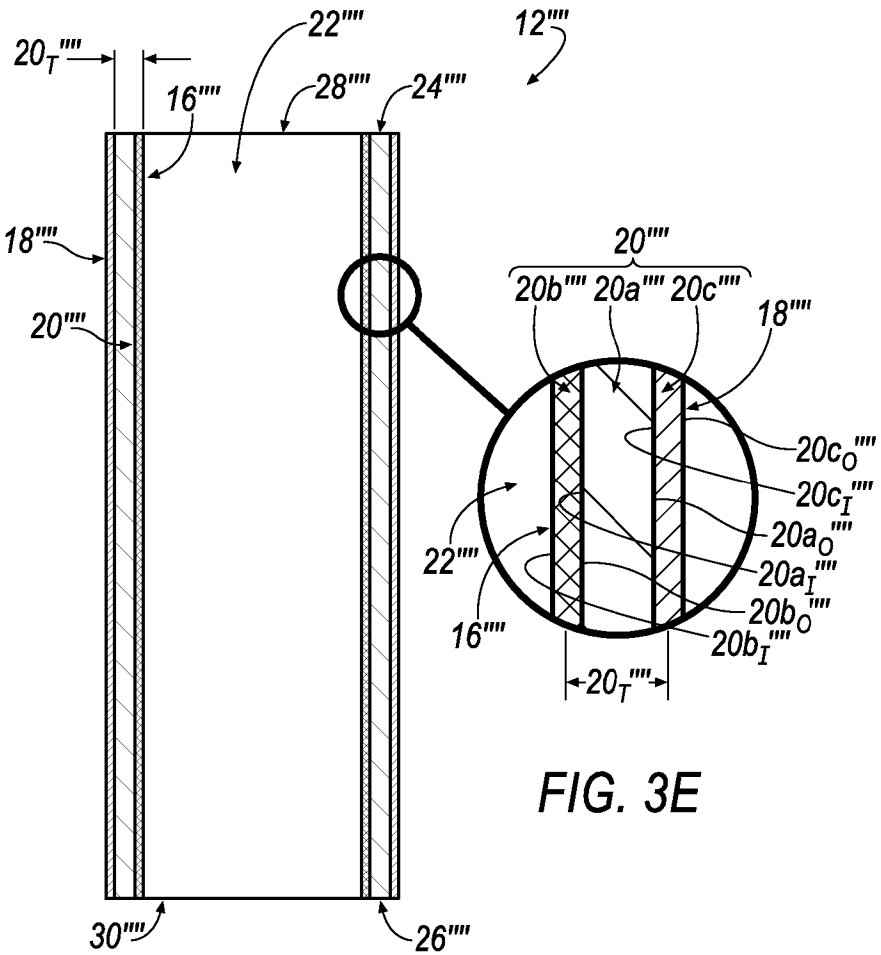
FIG. 2E is a cross-sectional view of the cylindrical sleeve according to line 2-2 of FIG. 1A.
FIG. 3E is an enlarged view of the cylindrical sleeve of FIG. 2E.

Referring to FIGS. 1A-1B, an assembly is shown generally at 10. The assembly includes a cylindrical sleeve 12 (see, e.g., FIGS. 2A and 3A), 12' (see, e.g., FIGS. 2B and 3B), 12" (see, e.g., FIGS. 2C and 3C) or 12'" (see, e.g., FIGS. 2D and 3D) and wound roll 14. A length of material, F, that is wound upon itself may define the wound roll 14.

Figure 4:
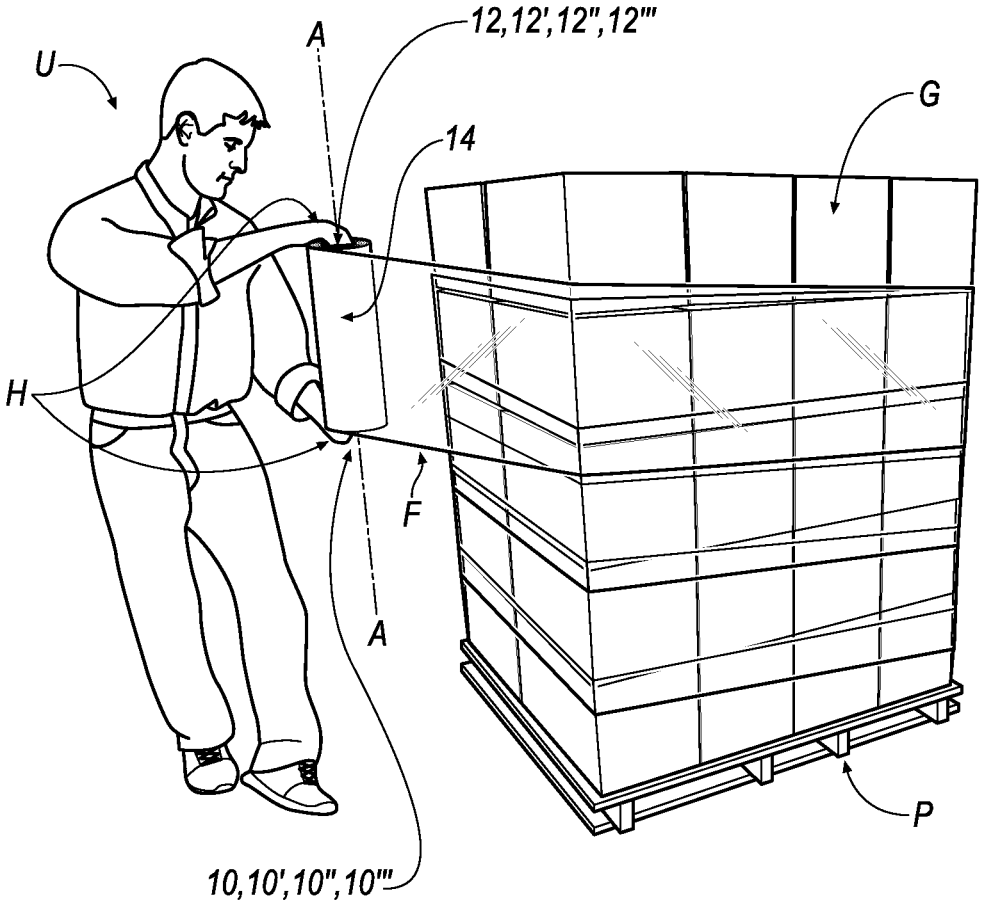
FIG. 4 is a view of a method for utilizing the assembly including the cylindrical sleeve of FIGS. 1A-1B.

In some implementations, the length of material, F, may be a length of wrapping film. As seen in FIG. 4, the length of wrapping film, F, may be dispensed/unwound from the wound roll 14 by a user, U, such that the length of wrapping film, F, may be disposed about and wrap a plurality of goods, G, that are arranged upon a pallet, P. Although some implementations of the length of material, F, may include a length of wrapping film, the length of material, F, may not be limited to including a length of wrapping film, and may alternatively include, for example, a length of paper, a length of tin foil or the like.

Referring back to FIGS. 1A-1B, the cylindrical sleeve 12, 12', 12", 12'" may include an inner surface 16, 16', 16", 16'" and an outer surface 18, 18', 18", 18'". The cylindrical sleeve 12, 12', 12", 12'" is defined by a body 20, 20', 20", 20'" of one or more materials (e.g., one material as seen in FIGS. 2C and 3C, or, alternatively, a first material 20*a* (see, e.g., FIGS. 2A and 3A), 20*a'* (see, e.g., FIGS. 2B and 3B), 20*a'"* (see, e.g., FIGS. 2D and 3D) and a second material 20*b* (see, e.g., FIGS. 2A and 3A), 20*b'* (see, e.g., FIGS. 2B and 3B), 20*b'"* (see, e.g., FIGS. 2D and 3D)). The body 20, 20', 20", 20'" is defined by a thickness, $\mathbf{20}_T$, $\mathbf{20}_T'$, $\mathbf{20}_T''$, $\mathbf{20}_T''$, $\mathbf{20}_T'''$ extending between the inner surface 16, 16', 16", 16'" and the outer surface 18, 18', 18", 18'".

The inner surface 16, 16', 16", 16'" defines a passage 22, 22', 22", 22'" extending through the cylindrical sleeve 12, 12', 12", 12'" between a distal end 24, 24', 24", 24'" of the cylindrical sleeve 12, 12', 12", 12'" and a proximal end 26, 26', 26", 26'" of the cylindrical sleeve 12, 12', 12", 12'". Access to the passage 22, 22', 22", 22'" is permitted by a distal opening 28, 28', 28", 28'" formed in the distal end 24, 24', 24", 24'" of the cylindrical sleeve 12, 12', 12", 12'" and a proximal opening 30, 30', 30", 30'" formed in the proximal end 26, 26', 26", 26'" of the cylindrical sleeve 12, 12', 12", 12'".

The length of material, F, includes an inner surface, $F_I$, and an outer surface, $F_O$. A portion of the inner surface, $F_I$, of the length of material, F, forms a passage 32 extending through the wound roll 14. The outer surface 18, 18', 18", 18'" of the cylindrical sleeve 12, 12', 12", 12'" may be secured to the portion of the inner surface, $F_I$, of the length of material, F, that forms the passage 32 extending through the wound roll 14. In some implementations, an adhesive (not shown) may be disposed over one or both of the outer surface 18, 18', 18", 18'" of the cylindrical sleeve 12, 12', 12", 12'" and the portion of the inner surface, $F_I$, of the length of material, F, that forms the passage 32 extending through the wound roll 14 for securing the cylindrical sleeve 12, 12', 12", 12'" to the wound roll 14.

Referring to FIGS. 2A and 3A, the exemplary cylindrical sleeve 12 is shown. Referring to FIG. 3A, the body 20 defining the cylindrical sleeve 12 includes at least a first material 20*a* and a second material 20*b*.

The first material 20*a* may include a cylindrical body having an inner surface $\mathbf{20}a_I$ and an outer surface $\mathbf{20}a_O$. The outer surface $\mathbf{20}a_O$ of the first material 20*a* may define the outer surface 18 of the cylindrical sleeve 12. The second material 20*b* may include a cylindrical body having an inner surface $20b_I$ and an outer surface $20b_O$. The inner surface $20b_I$ of the second material 20*b* may define the inner surface 16 of the cylindrical sleeve 12. The inner surface $20a_I$ of the first material 20*a* is disposed adjacent the outer surface $20b_O$ of the second material 20*b*.

In some implementations, the second material 20*b* is a liner that is disposed over the inner surface $20a_I$ of the first material 20*a*. In some examples, the outer surface $20b_O$ of the second material 20*b* is secured to the inner surface $20a_I$ of the first material 20*a* by an adhesive (not shown).

In some implementations, the first material 20*a* may include a rough, cardboard-based paper material that includes, but is not limited to a new/virgin paper material or a recycled paper material. In some examples, the second material 20*b* may include a paper material (e.g., a paper lining including a plush characteristic, such as velvet). In some instances, the second material 20*b* may include a non-paper material (e.g., a plastic lining). Although the first material 20*a* of FIG. 2A, which may include a rough, cardboard-based paper material, is shown including one layer of material, the first material 20*a* is not limited to including one layer of material; accordingly, in some instances, the first material 20*a*, which may include a rough, cardboard-based paper material, may include a plurality of layers of material. In some examples, a multi-layer first material 20*a* may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20*a* is formed to include a desired thickness. In some instances, if, for example, the rough, cardboard-based paper material paper is 0.025" thick, and, a desired thickness of the first material 20*a* is 0.25", ten strips of rough, cardboard-based paper material may be utilized as described above for forming the first material 20*a*.

Comparatively, a Sheffield Smoothness (SS) of the second material 20*b* is lower than a SS of the first material 20*a*; in some implementations, the first material 20*a* may be defined by a SS greater than 350 (e.g., a SS that is approximately equal to 370). In some implementations, the second material 20*b* may be defined by a SS that is less than 350; in an exemplary embodiment, the second material 20*b* may be defined by a SS approximately equal to 250.

As a result of the SS of the second material 20*b* being less than the SS of the first material 20*a*, the inner surface $20b_I$ of the second material 20*b* is defined by a SS that is less than a SS of the inner surface $20a_I$ of the first material 20*a*. Therefore, because the inner surface $20b_I$ of the second material 20*b* defines the inner surface 16 of the cylindrical sleeve 12, the inner surface 16 of the cylindrical sleeve 12 includes a lower SS than, for example a rough, cardboard-based paper material.

Although FIGS. 2A-3A show a first material 20*a* and a second material 20*b*, the cylindrical sleeve 12 is not limited to a first material 20*a* and a second material 20*b*. For example a cylindrical sleeve 12"" (see, e.g., FIGS. 2E and 3E) may include a first material (see, e.g., 20*a*"" in FIG. 3E), a second material (see, e.g., 20*b*"" in FIG. 3E) and a third material (see, e.g., 20*c*"" in FIG. 3E). The third material 20*c*"" may be arranged over and adjacent the outer surface $20a_O$"" of the first material 20*a*"". A Sheffield Smoothness (SS) of the third material 20*c*"" is lower than a SS of the first material 20*a*""; in some implementations, the first material 20*a*"" may be defined by a SS greater than 350 (e.g., a SS that is approximately equal to 370). In some implementations, the second and third materials 20*b*"", 20*c*"" may be defined by a SS that is less than 350; in an exemplary embodiment, the second and third materials 20*b*"", 20*c*"" may be defined by a SS approximately equal to 250.

Referring to FIGS. 2B and 3B, the exemplary cylindrical sleeve 12' is shown. The body 20' defining the cylindrical sleeve 12' includes at least a first material 20*a*' and a second material 20*b*'.

The first material 20*a*' may include a cylindrical body having an inner surface $20a_I$' and an outer surface $20a_O$'. The outer surface $20a_O$' of the first material 20*a*' may define the outer surface 18' of the cylindrical sleeve 12'. The second material 20*b*' may include a cylindrical body having an inner surface $20b_I$' and an outer surface $20b_O$'. The inner surface $20b_I$' of the second material 20*b*' may define the inner surface 16' of the cylindrical sleeve 12'. The inner surface $20a_I$' of the first material 20*a*' is disposed adjacent the outer surface $20b_O$' of the second material 20*b*'.

In some implementations, the second material 20*b*' is a coating that is disposed over the inner surface $20a_I$' of the first material 20*a*'. If the second material 20*b*' is a coating, in some instances, at the time the second material 20*b*' is applied (e.g., extruded, lapped, painted or the like) to the first material 20*a*', the outer surface $20b_O$' of the second material 20*b*' may include a tacky, adhesive quality that permits the outer surface $20b_O$' of the second material 20*b*' to bond to the inner surface $20a_I$' of the first material 20*a*' without the use of a binding agent (e.g., such as, for example, an adhesive). Once the second material 20*b*' has cured, the tacky, adhesive quality of the second material 20*b*' may define a smooth, non-tacky, non-adhesive quality.

In some implementations, the first material 20*a*' may include a rough, cardboard-based paper material that includes, but is not limited to a new/virgin paper material or a recycled paper material. In some instances, the second material 20*b*' may include a non-paper material (e.g., a plastic coating). Although the first material 20*a*' of FIG. 2B, which may include a rough, cardboard-based paper material, is shown including one layer of material, the first material 20*a*' is not limited to including one layer of material; accordingly, in some instances, the first material 20*a*', which may include a rough, cardboard-based paper material, may include a plurality of layers of material. In some examples, a multi-layer first material 20*a*' may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20*a*' is formed to include a desired thickness. In some instances, if, for example, the rough, cardboard-based paper material paper is 0.025" thick, and, a desired thickness of the first material 20*a*' is 0.25", ten strips of rough, cardboard-based paper material may be utilized as described above for forming the first material 20*a*'.

Comparatively, a Sheffield Smoothness (SS) of the second material 20*b*' is lower than a SS of the first material 20*a*'; in some implementations, the first material 20*a*' may be defined by a SS greater than 350 (e.g., a SS that is approximately equal to 370). In some implementations, the second material 20*b*' may be defined by a SS that is less than 350; in an exemplary embodiment, the second material 20$b'$ may be defined by a SS approximately equal to 250.

As a result of the SS of the second material 20$b'$ being less than the SS of the first material 20$a'$, the inner surface 20$b_I'$ of the second material 20$b'$ is defined by a SS that is less than a SS of the inner surface 20$a_I'$ of the first material 20$a'$. Therefore, because the inner surface 20$b_I'$ of the second material 20$b'$ defines the inner surface 16' of the cylindrical sleeve 12', the inner surface 16' of the cylindrical sleeve 12' includes a lower SS than, for example a rough, cardboard-based paper material.

Although FIGS. 2B-3B show a first material 20$a'$ and a second material 20$b'$, the cylindrical sleeve 12' is not limited to a first material 20$a'$ and a second material 20$b'$. For example a cylindrical sleeve 12"" (see, e.g., FIGS. 2E and 3E) may include a first material (see, e.g., 20$a$"" in FIG. 3E), a second material (see, e.g., 20$c$"" in FIG. 3E) and a third material (see, e.g., 20$c$"" in FIG. 3E). The third material 20$c$"" may be arranged over and adjacent the outer surface 20$a_O$"" of the first material 20$a$"". A Sheffield Smoothness (SS) of the third material 20$c$"" is lower than a SS of the first material 20$a$""; in some implementations, the first material 20$a$"" may be defined by a SS greater than 350 (e.g., a SS that is approximately equal to 370). In some implementations, the second and third materials 20$b$"", 20$c$"" may be defined by a SS that is less than 350; in an exemplary embodiment, the second and third materials 20$b$"", 20$c$"" may be defined by a SS approximately equal to 250.

Referring to FIGS. 2C and 3C, the exemplary cylindrical sleeve 12" is shown. Unlike the exemplary cylindrical sleeves 12, 12' described above, the body 20" of the exemplary cylindrical sleeve 12" does not include two materials (e.g., 20$a$, 20$b$ as seen in FIG. 3A or 20$a'$, 20$b'$ as seen in FIG. 3B), but, rather, one material. The body 20" may include a cylindrical body having an outer surface 20$_O$" and an inner surface 20$_I$".

The body 20" is not composed of a rough, cardboard-based paper material. In some instances, the body 20" may include a non-cardboard-based paper material (e.g., a plastic material); hereinafter, the body 20" is referred to as a non-cardboard-based body. The non-cardboard-based body 20" may be formed, for example, in an injection molding procedure.

Comparatively, a Sheffield Smoothness (SS) of the non-cardboard-based body 20" is lower than a SS of a cardboard-based paper material. In some implementations, a cardboard-based paper material may be defined by a SS greater than 350 (e.g., a SS that is approximately equal to 370). In some implementations, the non-cardboard-based body 20" may be defined by a SS that is less than 350; in an exemplary embodiment, the non-cardboard-based body 20" may be defined by a SS approximately equal to 250.

As a result of the SS of the non-cardboard-based body 20" being less than the SS of a cardboard-based paper material, the inner surface 20$_I$" of the non-cardboard-based body 20" is defined by a SS that is less than a SS of a cardboard-based paper material. Therefore, because the inner surface 20$_I$" of non-cardboard-based body 20" defines the inner surface 16" of the cylindrical sleeve 12", the inner surface 16" of the cylindrical sleeve 12" includes a lower SS than, for example a rough, cardboard-based paper material.

Referring to FIGS. 2D and 3D, the exemplary cylindrical sleeve 12'" is shown. The body 20'" defining the cylindrical sleeve 12'" includes at least a first material 20$a$"" and a second material 20$b'''$.

The first material 20$a$'" may include a cylindrical body having an inner surface 20$a_I$'" and an outer surface 20$a_O$'". The outer surface 20$a_O$'" of the first material 20$a$'" may define at least a portion of the outer surface 18'" of the cylindrical sleeve 12'" and at least a portion of the inner surface 16'" of the cylindrical sleeve 12'". The second material 20$b$'" may include a plurality of impregnations that are disposed throughout the cylindrical body of the first material 20$a$'". Therefore, when the impregnations defining the second material 20$b$'" are entirely contained within the cylindrical body of the first material 20$a$'", in some instances, the second material 20$b$'" does not form an inner surface or outer surface that contributes to any of the inner surface 16'" or the outer surface 18'" of the cylindrical sleeve 12'"; however, when the impregnations defining the second material 20$b$'" are not entirely contained within the cylindrical body of the first material 20$a$'", in some instances, the second material 20$b$'" may serially form a plurality of inner surface portions 20$b_I$'" and a plurality of outer surface portions 20$b_O$'" that defines at least a portion of the outer surface 18'" of the cylindrical sleeve 12'" and at least a portion of the inner surface 16'" of the cylindrical sleeve 12'".

In some implementations, the first material 20$a$'" may include a rough, cardboard-based paper material that includes, but is not limited to a new/virgin paper material or a recycled paper material. In some instances, the second material 20$b$'" may include a hardwood material. Although the first material 20$a$'" of FIG. 2D, which may include a rough, cardboard-based paper material, is shown including one layer of material, the first material 20$a$'" is not limited to including one layer of material; accordingly, in some instances, the first material 20$a$'", which may include a rough, cardboard-based paper material, may include a plurality of layers of material. In some examples, a multi-layer first material 20$a$'" may be formed by winding a strip of rough, cardboard-based paper material (e.g., Brown Kraft paper, which may alternatively be referred to as recycled paper) on a mandrel in a spiral with edges of the rough, cardboard-based paper material arranged adjacent one another forming a spiral seam; subsequently, one or more second strips of rough, cardboard-based paper material may be wound over the first rough, cardboard-based paper material arranged upon the mandrel until the first material 20$a$'" is formed to include a desired thickness. In some instances, if, for example, the rough, cardboard-based paper material paper is 0.025" thick, and, a desired thickness of the first material 20$a$'" is 0.25", ten strips of rough, cardboard-based paper material may be utilized as described above for forming the first material 20$a'''$.

Comparatively, a Sheffield Smoothness (SS) of the second material 20$b$'" is lower than a SS of the first material 20$a$'"; in some implementations, the first material 20$a$'" may be defined by a SS greater than 350 (e.g., a SS that is approximately equal to 370). In some implementations, the second material 20$b$'" may be defined by a SS that is less than 350; in an exemplary embodiment, the second material 20$b$'" may be defined by a SS approximately equal to 250.

As a result of the SS of the second material 20$b$'" being less than the SS of the first material 20$a$'", the plurality of inner surface portions 20$b_I$'" of the second material 20$b$'" (that defines at least a portion of the inner surface 16'" of the cylindrical sleeve 12'") is defined by a SS that is less than a SS of the inner surface 20$a_I$'" of the first material 20$a$'" (that also defines at least a portion of the inner surface 16'" of the cylindrical sleeve 12'"). Therefore, because the plurality of inner surface portions 20$b_I$'" of the second material 20$b$'" defines at least a portion of the inner surface 16'" of the cylindrical sleeve 12'", the second material 20$b$'" reduces the SS of the inner surface 16''' of the cylindrical sleeve 12''' that is at least partially defined by the first material 20a''' including, for example a rough, cardboard-based paper material.

Figure 5A:
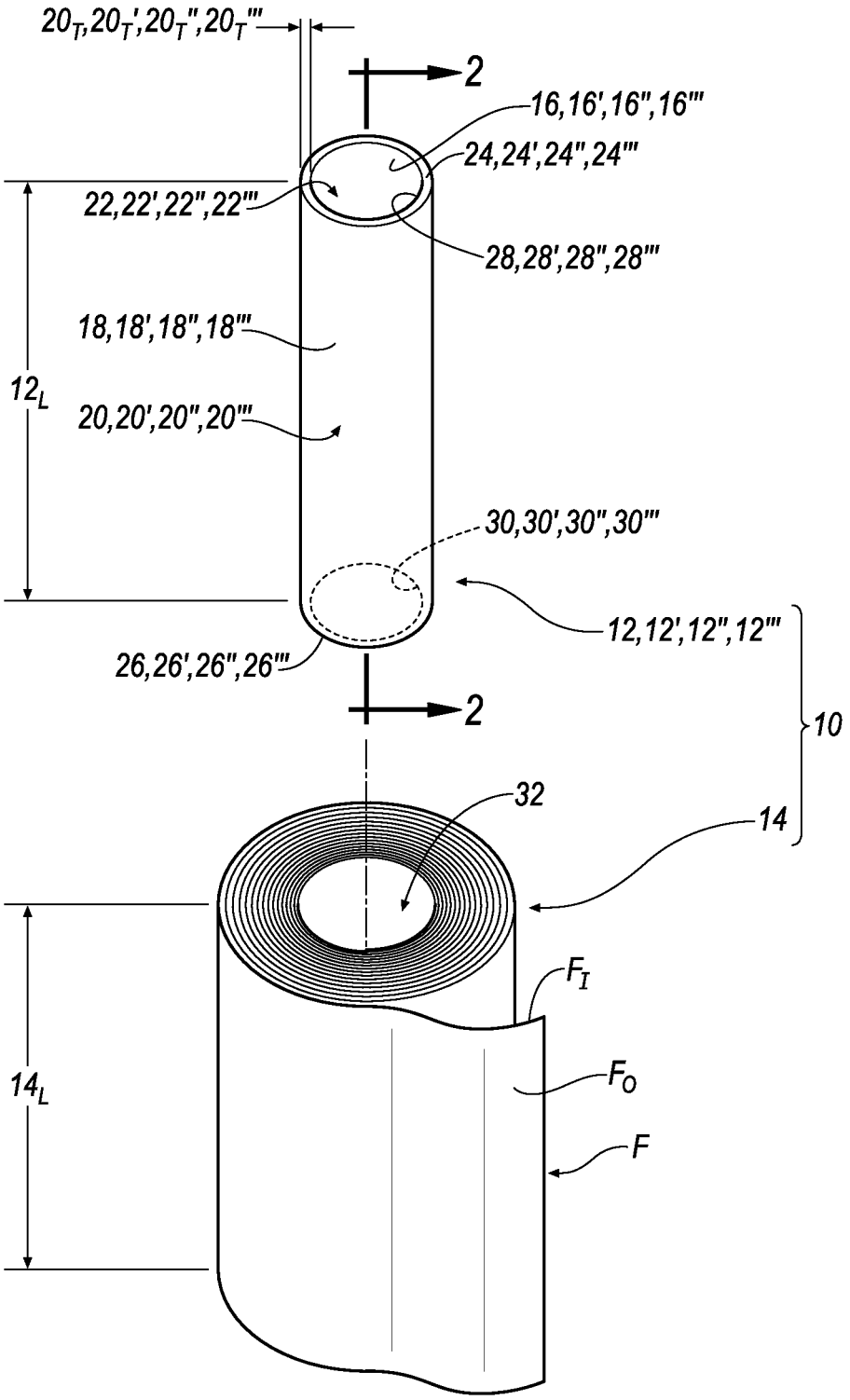
FIG. 5A is an exploded perspective view of an assembly including a cylindrical sleeve in accordance with an exemplary embodiment of the invention.
Figure 5B:
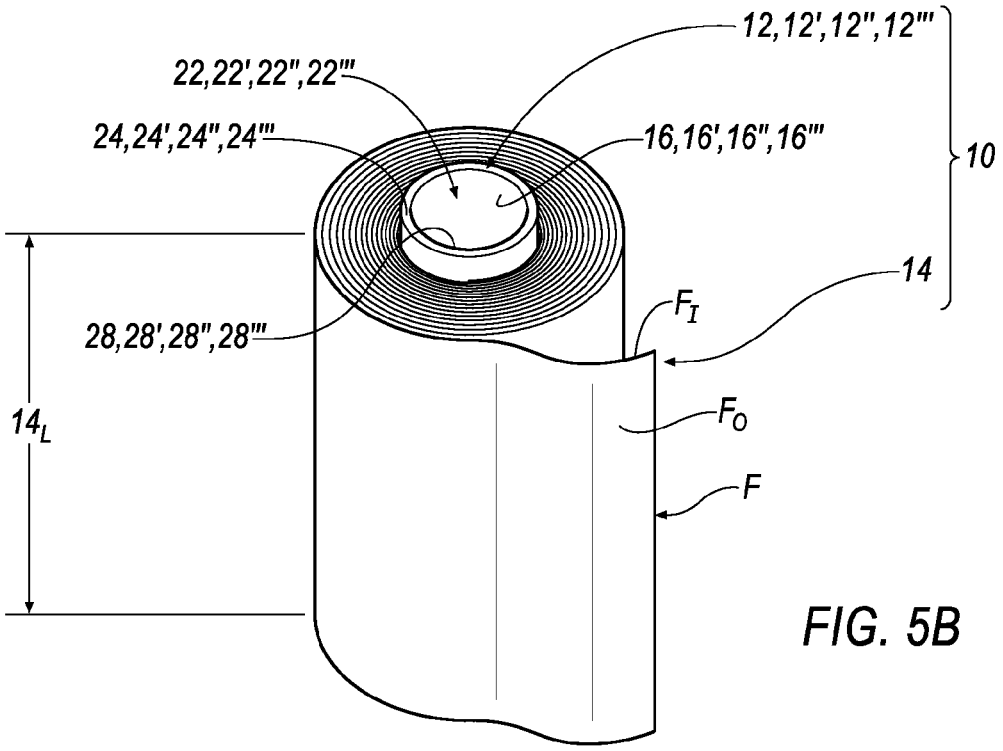
FIG. 5B is an assembled perspective view of the assembly of FIG. 5A.
Figure 5C:
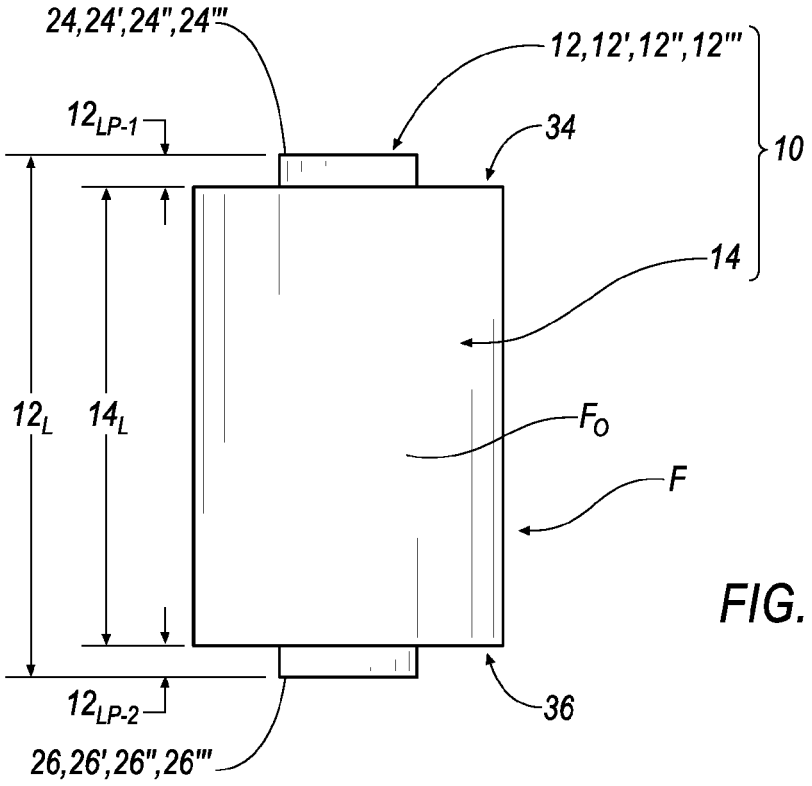
FIG. 5C is a side view of the assembly of FIG. 5B.

Referring to FIG. 4, because the inner surface 16, 16', 16'', 16''' of the cylindrical sleeve 12, 12', 12'', 12''' is defined by a lower SS in comparison to, for example, a rough, cardboard-based paper material, a user, U, may insert his/her hands, H, directly into the passage 22, 22', 22'', 22''' extending through the cylindrical sleeve 12, 12', 12'', 12''' such that one or more of the user's, U, hands, H, may be in direct contact with the inner surface 16, 16', 16'', 16''' of the cylindrical sleeve 12, 12', 12'', 12''' when the wound roll 14 spins about an axis of rotation, A-A, as the length of wrapping film, F, is dispensed/unwound from the wound roll 14 due to the lower SS of the inner surface 16, 16', 16'', 16''' of the cylindrical sleeve 12, 12', 12'', 12''' promoting increased comfort to the user's, U, hands, H, in comparison to, for example, a cylindrical sleeve that consists only of, for example, a rough, cardboard-based paper material. Further, because the inner surface 16, 16', 16'', 16''' of the cylindrical sleeve 12, 12', 12'', 12''' is defined by a lower SS in comparison to, for example, a rough, cardboard-based paper material, the assembly 10 obviates use of gloves for the user's, U, hands, H, due to the increased comfort imparted to the user's, U, hands, H. Even further, because the inner surface 16, 16', 16'', 16''' of the cylindrical sleeve 12, 12', 12'', 12''' is defined by a lower SS in comparison to, for example, a rough, cardboard-based paper material, the assembly 10 obviates use of an axial insert, which may include, for example, hand grips, that would otherwise be inserted into the passage 22, 22', 22'', 22''' extending through the cylindrical sleeve 12, 12', 12'', 12''' due to the increased comfort imparted to the user's, U, hands, H, as described above. Yet even further, although the cylindrical sleeve 12, 12', 12'', 12''' and the wound roll 14 illustrated in FIG. 1B are shown having substantially aligned or substantially flush axial ends, some implementations of the assembly 10 may include portions $\mathbf{12}_{LP\text{-}1}$, $\mathbf{12}_{LP\text{-}2}$ (see, e.g., FIG. 5C) of the cylindrical sleeve 12, 12', 12'', 12''' that extend beyond axial ends 34, 36 (see, e.g., FIG. 5C) of the wound roll 14. In some instances, as seen in, for example, FIGS. 5A-5C, the cylindrical sleeve 12, 12', 12'', 12''' may include a length $\mathbf{12}_L$ that is greater than a length $\mathbf{14}_L$ of the wound roll 14; accordingly, when the cylindrical sleeve 12, 12', 12'', 12''' is disposed within the passage 32 extending through the wound roll 14, a first portion $\mathbf{12}_{LP\text{-}1}$ of the length $\mathbf{12}_L$ of the cylindrical sleeve 12, 12', 12'', 12''' may extend beyond an upper axial end 34 of the would roll 14 and a second portion $\mathbf{12}_{LP\text{-}2}$ of the length $\mathbf{12}_L$ of the cylindrical sleeve 12, 12', 12'', 12''' may extend beyond a lower axial end 36 of the would roll 14. Such implementations may permit a user to grasp the outer surface 18, 18', 18'', 18''' of the portions $\mathbf{12}_{LP\text{-}1}$, $\mathbf{12}_{LP\text{-}2}$ of the length $\mathbf{12}_L$ of the cylindrical sleeve 12, 12', 12'', 12'''. In such implementations, a portion of the outer surface 18, 18', 18'', 18''' of the cylindrical sleeve 12, 12', 12'', 12''' may formed in a manner to define a lower SS in comparison to, for example, a rough, cardboard-based paper material in a substantially similar as described above with respect to the inner surface 16, 16', 16'', 16''' of the cylindrical sleeve 12, 12', 12'', 12'''. In addition, some implementations of the assembly 10 may also include axial ends of the cylindrical sleeve 12, 12', 12'', 12''' (that connect the inner surface 16, 16', 16'', 16''' to the outer surface 18, 18', 18'', 18''') that define a lower SS in comparison to, for example, a rough, cardboard-based paper material.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. An assembly, comprising:

a cylindrical sleeve including an inner surface and an outer surface, wherein the inner surface of the cylindrical sleeve defines a passage extending through the cylindrical sleeve; and a length of material that is wound upon itself defining a wound roll, wherein the length of material includes an inner surface and an outer surface, wherein a portion of the inner surface of the length of material forms a passage extending through the wound roll, wherein the outer surface of the cylindrical sleeve is secured to the portion of the inner surface of the length of material that forms the passage extending through the wound roll, wherein at least a portion of the inner surface of the cylindrical sleeve is defined by a Sheffield Smoothness that is less than 350.

2. The assembly according to claim 1, wherein the Sheffield Smoothness defined by the inner surface of the cylindrical sleeve is approximately equal to 250.

3. The assembly according to claim 1, wherein the length of material is a length of wrapping film.

4. The assembly according to claim 1, wherein the passage extends through the cylindrical sleeve between a distal end of the cylindrical sleeve and a proximal end of the cylindrical sleeve, wherein access to the passage is permitted by a distal opening formed in the distal end of the cylindrical sleeve and a proximal opening formed in the proximal end of the cylindrical sleeve.

5. The assembly according to claim 1, wherein the cylindrical sleeve is defined by a body, wherein the body is defined by a thickness extending between the inner surface and the outer surface.

6. The assembly according to claim 5, wherein the body is defined by one or more materials.

7. The assembly according to claim 6, wherein the body includes two materials defined by:

a first material, and a second material.

8. The assembly according to claim 7, wherein the first material forms a first cylindrical body having an inner surface and an outer surface, wherein the outer surface of the first material defines the outer surface of the cylindrical sleeve, wherein the second material forms a second cylindrical body having an inner surface and an outer surface, wherein the inner surface of the second material defines the inner surface of the cylindrical sleeve, wherein the inner surface of the first cylindrical body formed by the first material is disposed adjacent the outer surface of the second cylindrical body formed by the second material.

9. The assembly according to claim 8, wherein the second material defining the inner surface of the cylindrical sleeve is defined by the Sheffield Smoothness that is less than 350, wherein the first material has a Sheffield Smoothness that is greater than 350.

10. The assembly according to claim 9, wherein the first material is a rough, cardboard-based paper material.

11. The assembly according to claim 10, wherein the second material is a paper liner, wherein the paper liner includes velvet.

12. The assembly according to claim 10, wherein the second material is a plastic liner.

13. The assembly according to claim 10, wherein the second material is a plastic coating.

14. The assembly according to claim 7, wherein the first material forms a cylindrical body having an inner surface and an outer surface, wherein the inner surface of the cylindrical body defines at least a first portion of the outer surface of the cylindrical sleeve, wherein the outer surface of the cylindrical body defines at least a first portion of the outer surface of the cylindrical sleeve, wherein the second material forms a plurality of impregnations that are disposed throughout the cylindrical body formed by the first material, wherein some of the plurality of impregnations are entirely contained within the cylindrical body formed by the first material, wherein some of the plurality of impregnations are not entirely contained within the cylindrical body formed by the first material and thereby defines a plurality of inner surface portions and a plurality of outer surface portions, wherein the plurality of inner surface portions define at least a second portion of the inner surface of the cylindrical sleeve, wherein the plurality of outer surface portions define at least a second portion of the outer surface of the cylindrical sleeve.

15. The assembly according to claim 14, wherein the second material defining at least the second portion of the inner surface of the cylindrical sleeve is defined by the Sheffield Smoothness that is less than 350, wherein the first material has a Sheffield Smoothness that is greater than 350.

16. The assembly according to claim 15, wherein the first material is a rough, cardboard-based paper material.

17. The assembly according to claim 16, wherein the second material is a hardwood material.

18. The assembly according to claim 6, wherein the body includes one material that forms a cylindrical body having an inner surface and an outer surface, wherein the outer surface of the cylindrical body defines the outer surface of the cylindrical sleeve, wherein the inner surface of the cylindrical body defines the inner surface of the cylindrical sleeve, wherein the one material that forms the cylindrical body is a non-cardboard-based body.

19. A method, comprising the steps of:

providing the assembly of claim 1;

without arranging an axial insert disposed within the passage extending through the cylindrical sleeve, arranging an operators hands directly adjacent the portion of the inner surface of the cylindrical sleeve defined by the Sheffield Smoothness that is less than 350; and spinning the wound roll about an axis of rotation extending through the passage extending through the cylindrical sleeve for dispensing the length of material from the wound roll.

20. The assembly according to claim 1, wherein an axial end of the cylindrical sleeve extends beyond the length of material.

21. An assembly, comprising:

a cylindrical sleeve including an inner surface and an outer surface, wherein the inner surface of the cylindrical sleeve defines a passage extending through the cylindrical sleeve, wherein the cylindrical sleeve is defined by a body, wherein the body is defined by a first material and a second material, wherein the first material is defined by a Sheffield Smoothness that is greater than 350, wherein the second material is defined by a Sheffield Smoothness that is less than 350, wherein at least a portion of the inner surface of the cylindrical sleeve is defined by the second material having the Sheffield Smoothness that is less than 350; and a length of wrapping film that is wound upon itself defining a wound roll, wherein the length of wrapping film includes an inner surface and an outer surface, wherein a portion of the inner surface of the length of wrapping film forms a passage extending through the wound roll, wherein the outer surface of the cylindrical sleeve is secured to the portion of the inner surface of the length of wrapping film that forms the passage extending through the wound roll.

22. The assembly according to claim 21, wherein the first material is a rough, cardboard-based paper material, wherein the second material is not a rough, cardboard-based paper material.

23. The assembly according to claim 22, wherein the second material is a paper liner, wherein the paper liner includes velvet.

24. The assembly according to claim 22, wherein the second material is a plastic liner.

25. The assembly according to claim 22, wherein the second material is a plastic coating.

26. The assembly according to claim 22, wherein the second material is a plurality of hardwood impregnations that are disposed throughout the first material.

* * * * *